US009969047B2

(12) United States Patent
Cho et al.

(10) Patent No.: US 9,969,047 B2
(45) Date of Patent: May 15, 2018

(54) SUBSTRATE POLISHING APPARATUS

(71) Applicant: Samsung Display Co., Ltd., Yongin-Si, Gyeonggi-Do (KR)

(72) Inventors: Joowoan Cho, Seongnam-si (KR); Hyunjin Cho, Seoul (KR); Byoungkwon Choo, Hwaseong-si (KR); Oleg Prudnikov, Hwaseong-si (KR); Jeongkyun Na, Suwon-si (KR); Sanghoon Ahn, Seoul (KR); Seunghwan Lee, Seoul (KR); Byoungho Cheong, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 212 days.

(21) Appl. No.: 15/138,630

(22) Filed: Apr. 26, 2016

(65) Prior Publication Data

US 2016/0318149 A1 Nov. 3, 2016

(30) Foreign Application Priority Data

Apr. 28, 2015 (KR) ..... 10-2015-0059940

(51) Int. Cl.
*B24B 37/20* (2012.01)

(52) U.S. Cl.
CPC ..... *B24B 37/20* (2013.01)

(58) Field of Classification Search
CPC ..... B24B 37/20; B24B 7/24; B24B 7/224; B24B 7/22; B24B 7/244; B24B 3/38
USPC .... 451/160, 162, 280, 231, 240, 42, 60, 277
See application file for complete search history.

(56) References Cited

U.S. PATENT DOCUMENTS 279,001 A * 6/1883 Morris ..... B24B 19/226 451/271
1,666,347 A * 4/1928 Platt ..... B24B 7/244 15/102
3,948,007 A * 4/1976 Feneberg ..... B24B 9/142 351/159.02
5,934,979 A * 8/1999 Talieh ..... B24B 21/004 451/271
6,113,472 A * 9/2000 Rosa ..... B24B 5/045 451/11

(Continued)

FOREIGN PATENT DOCUMENTS

JP 83888 * 4/2011
JP 2012253259 A 12/2012

(Continued)

*Primary Examiner* — George Nguyen
(74) *Attorney, Agent, or Firm* — Cantor Colburn LLP

(57) ABSTRACT

A substrate polishing apparatus includes a support part on which at least one substrate is disposed, a plurality of first moving parts disposed at both opposite sides of the support part in a second direction crossing a first direction, and configured to upwardly extend and reciprocate in the first direction, a second moving part disposed between the plurality of first moving parts in the second direction and connected to an upper side of the first moving parts, a plurality of polishing units disposed at a lower portion of the second moving part and configured to contact an upper surface of the substrate, and a plurality of nozzles disposed at the lower portion of the second moving part and configured to spray slurry to the substrate where the polishing units rotate and revolve along a predetermined trajectory.

17 Claims, 4 Drawing Sheets

(56) References Cited

U.S. PATENT DOCUMENTS 6,227,945 B1 * 5/2001 Takahashi ..... B24B 9/065 451/108
6,296,550 B1 10/2001 Liu et al.
6,506,098 B1 * 1/2003 Ho ..... B24B 37/04 156/345.12
6,602,121 B1 * 8/2003 Halley ..... B24B 37/20 451/287
6,612,905 B2 * 9/2003 Nguyen ..... B24B 37/30 451/28
6,626,744 B1 * 9/2003 White ..... B24B 21/04 451/168
6,706,139 B1 * 3/2004 Moore ..... B24B 21/04 156/345.12
7,273,406 B2 * 9/2007 McGlinchy ..... B24B 7/075 451/231
9,821,428 B2 * 11/2017 Yoshikawa ..... B24B 5/08
2002/0022440 A1 * 2/2002 Kunugi ..... B24B 37/04 451/60
2002/0090893 A1 * 7/2002 Hsu ..... B24B 37/042 451/41
2006/0211181 A1 9/2006 Chung
2007/0233306 A1 * 10/2007 Takada ..... B24B 37/013 451/66
2008/0182392 A1 7/2008 Yeh et al.
2012/0100779 A1 4/2012 Dhandapani et al.
2013/0267148 A1 10/2013 Ramavajjala et al.
2013/0316620 A1 11/2013 Loebmann et al.
2014/0000808 A1 1/2014 Singh et al.
2014/0273763 A1 * 9/2014 Lee ..... B24B 53/017 451/56
2014/0329439 A1 11/2014 Chew et al.
2015/0027491 A1 1/2015 Sakata et al.

FOREIGN PATENT DOCUMENTS

KR 1020110124523 A 11/2011
WO WO 2007014732 A2 * 2/2007 ..... B24B 7/224

* cited by examiner

SUBSTRATE POLISHING APPARATUS

This application claims priority to Korean Patent Application No. 10-2015-0059940, filed on Apr. 28, 2015, and all the benefits accruing therefrom under 35 U.S.C. § 119, the content of which in its entirety is herein incorporated by reference.

BACKGROUND

1. Field

The exemplary embodiments of the invention herein relate to a display device, and particularly to, a substrate polishing apparatus capable of easily polishing substrates with various sizes.

2. Description of the Related Art

In general, display devices include a plurality of electronic elements driving pixels. When a display device is manufactured, electronic elements are provided on a substrate. A low temperature polysilicon ("LTPS") process may be used to form a semiconductor layer of electronic elements.

The low temperature polysilicon process is a process in which amorphous silicon disposed on the substrate is crystallized to polysilicon having high electron mobility at a low temperature. During the low polysilicon process, an Eximer laser annealing process in which amorphous silicon is irradiated with an Eximer laser is performed.

When the low polysilicon process is performed, amorphous silicon is melt and is then changed into polysilicon while being cooled into a solid state. Here, protrusions are disposed on a surface of the polysilicon. To remove these protrusions, a substrate polishing apparatus is used. Methods for polishing substrates are subdivided into chemical polishing methods and mechanical polishing methods.

A substrate polishing apparatus used in chemical polishing methods includes an upper plate adsorbing a substrate, a pad polishing the substrate, a lower plate disposed under the upper plate, and a slurry supply part supplying the lower plate with slurry which is a chemical polishing agent.

The lower plate rotates in a predetermined direction, and the upper plate moves on the lower plate while rotating in a predetermined direction. A surface of the substrate is polished by the slurry supplied between the polishing pad and the substrate.

SUMMARY

As a size of a display device becomes greater, a size of the substrate becomes greater. As the size of the substrate becomes greater, a size of the upper plate used in the polishing process should become greater. However, as the size of the upper plate disposed over the lower plate increases, the weight of the upper plate also increases. Thus, it becomes difficult to support the upper plate. Accordingly, there is a limit to increasing the size of the upper plate.

The exemplary embodiments of the invention provide a substrate polishing apparatus capable of easily polishing substrates with various sizes.

Embodiments of the invention provide a substrate polishing apparatus including a support part on which at least one substrate is disposed, a plurality of first moving parts disposed at both opposite sides of the support part in a second direction crossing a first direction, and configured to upwardly extend and reciprocate in the first direction, a second moving part disposed between the plurality of first moving parts in the second direction and connected to an upper side of the first moving parts, a plurality of polishing units disposed at a lower portion of the second moving part and configured to contact an upper surface of the substrate, and a plurality of nozzles disposed at the lower portion of the second moving part and configured to spray slurry to the substrate, wherein the plurality of polishing units rotates and revolves along a predetermined trajectory.

In an exemplary embodiment, the support part may include a first support part on which the first moving parts are disposed, and a second support part disposed on the first support part, wherein the first moving parts may be disposed on predetermined regions at both opposite sides of the first support part in the second direction, and the substrate may be disposed on the second support part.

In an exemplary embodiment, a length of the first support part and a length second support part may be the same in the first direction, the length of the first support part may be longer than the length of the second support part in the second direction, and a region of the first support part except for the predetermined regions at both opposite sides of the first support part may be disposed to overlap the second support part.

In an exemplary embodiment, the first support part may include a moving grooves downwardly recessed from an upper surface of the first support part in the predetermined regions of both opposite sides of the first support part, and configured to extend in the first direction, wherein the first moving parts may be disposed respectively corresponding to the moving grooves and may reciprocate in the first direction along the moving grooves.

In an exemplary embodiment, the second support part may include a groove disposed to be downwardly recessed from an upper surface of the second support part.

In an exemplary embodiment, the substrate polishing apparatus may further include a stage disposed at the groove, wherein the substrate may be disposed on the stage and fixed.

In an exemplary embodiment, in a third direction crossing the first and second directions, a thickness of the stage may be greater than or equal to a depth of the groove.

In an exemplary embodiment, each of the first moving parts may include a first extension part disposed on predetermined regions at both opposite sides of the first support part in the second direction and configured to upwardly extend and configured to reciprocate in the first direction, and two second extension parts connected to an upper side of the first extension part and configured to extend in a direction toward an inner side of the support part in the second direction, wherein predetermined regions at both opposite sides of the second moving part in the second direction may be disposed between the second extension parts and connected to the second extension parts.

In an exemplary embodiment, a portion to which the first and second extension parts may be connected has a shape of a curved surface.

In an exemplary embodiment, each of the plurality of polishing units may include a rotation axis connected to a lower portion of the second moving part, a pad support part disposed under the rotation axis, and a polishing pad disposed under the pad support part, wherein each polishing unit may rotate clockwise or counter-clockwise about the rotation axis.

In an exemplary embodiment, lengths of the plurality of nozzles in a third direction crossing the first and second directions may be smaller than lengths of the rotation axes.

In an exemplary embodiment, the second moving part may include a moving rail part disposed on the lower portion of the second moving part and configured to have a predetermined track, wherein the rotation axes may be inserted into the moving rail part and move along the predetermined track in a clockwise or counter-clockwise direction along the moving rail part.

In an exemplary embodiment, the track of the moving rail part may extend in the second direction, and the tracks at both opposite sides of the moving rail part in the second direction may have a semi-circular shape.

In an exemplary embodiment, a length of the track of the moving rail part in the second direction may be greater than a length of the substrate, and the track, of the moving rail part, which has the semi-circular shape may be disposed not to overlap the substrate.

In an exemplary embodiment, the plurality of nozzles may be spaced apart by a predetermined distance from both opposite sides of the second moving part toward an inner side of the second moving part in the first direction, and arranged in the second direction.

In an exemplary embodiment, the plurality of nozzles may be disposed to overlap the first substrate and not to overlap the moving rail part.

In an exemplary embodiment, the plurality of nozzles may be fixed and spray the slurry.

BRIEF DESCRIPTION OF THE DRAWINGS

The accompanying drawings are included to provide a further understanding of the invention, and are incorporated in and constitute a part of this specification. The drawings illustrate exemplary embodiments, advantages and features of the invention and, together with the description, serve to explain principles of the invention. In the drawings.

DETAILED DESCRIPTION

Figure 1:
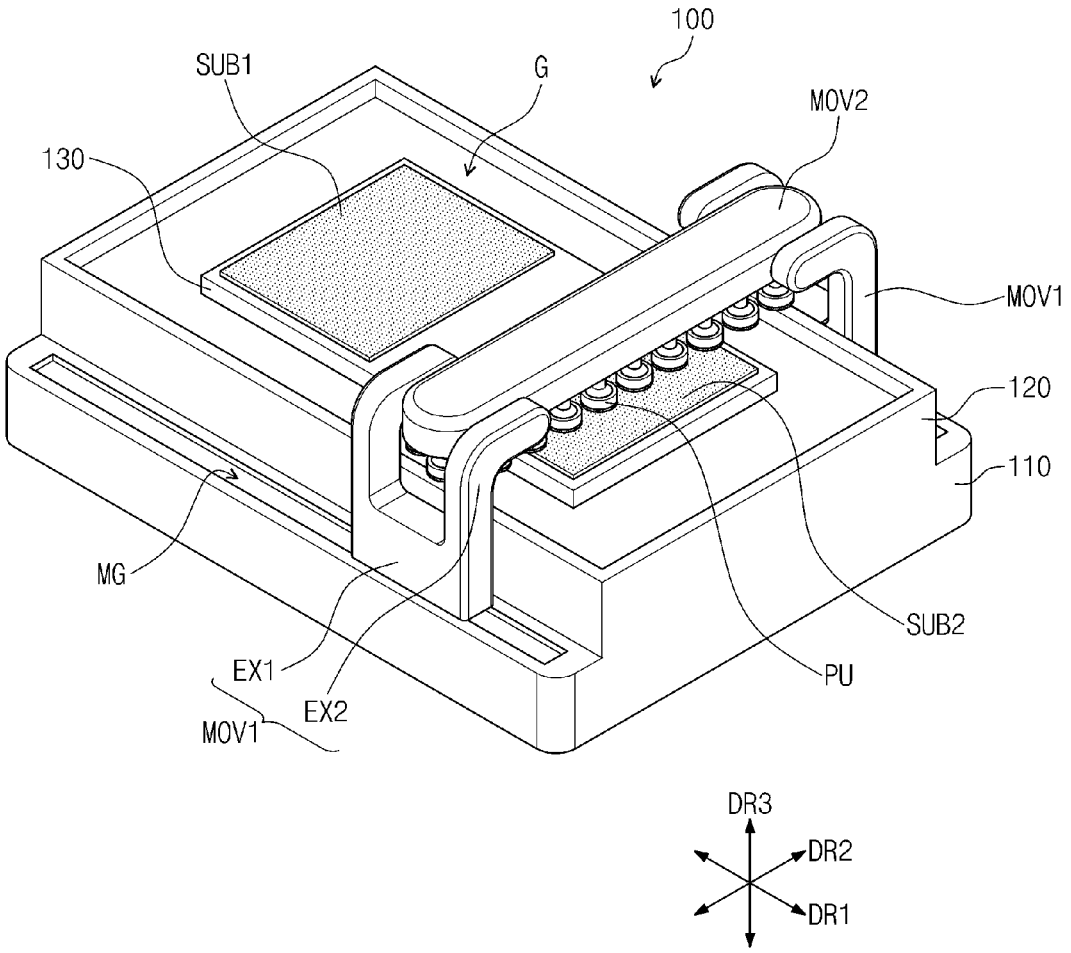
FIG. 1 is a perspective view illustrating a substrate polishing apparatus according to an exemplary embodiment of the invention.

Advantages and features of the invention, and implementation methods thereof will be clarified through following embodiments described with reference to the accompanying drawings. The invention may, however, be embodied in different forms and should not be construed as limited to the exemplary embodiments set forth herein. Rather, these embodiments are provided so that this disclosure will be thorough and complete, and will fully convey the scope of the invention to those skilled in the art. Further, the invention is only defined by scopes of claims. Like reference numerals refer to like elements throughout.

It will be understood that when an element or a layer is referred to as being 'on' another element or layer, it can be directly on the other element or layer, or intervening layers or elements may also be present. On the contrary, when an element is referred to as being 'directly on' another element or layer, it will be understood that intervening layers or elements are not present The term 'and/or' includes any and all combinations of one or more of the associated listed item.

The terms "below", "beneath", "lower", "above" and "upper" representing spatial relativity may be used to easily describe the correlation between an element or component and another element or component as shown in the drawings. The terms representing spatial relativity should be understood as terms including different directions of an element in use or in operation in addition to the direction shown in the drawings. Like reference numerals refer to like elements throughout.

It will be understood that, although the terms first, second, etc. may be used herein to describe various elements, components, and/or sections, these elements, components, and/or sections should not be limited by these terms. These terms are only used to distinguish one element, component, and/or sections from another element, component, and/or sections. Thus, for example, a first element, a first component or a first section discussed below could be termed a second element, a second component or a second section without departing from the teachings of the invention.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Embodiments described in the disclosure are described with reference to plane views and cross-sectional views that are ideal, schematic diagrams of the invention. Accordingly, shapes of the exemplary views may be modified according to manufacturing techniques and/or allowable errors. Therefore, the exemplary embodiments of the invention are not limited to the specific shape illustrated in the exemplary views, but may include other shapes that may be created according to manufacturing processes. Areas exemplified in the drawings have general properties, and are used to illustrate a specific shape of a semiconductor package region. Thus, this should not be construed as limited to the scope of the invention.

Hereinafter, exemplary embodiments will be described in detail with reference to the accompanying drawings.

Figure 2:
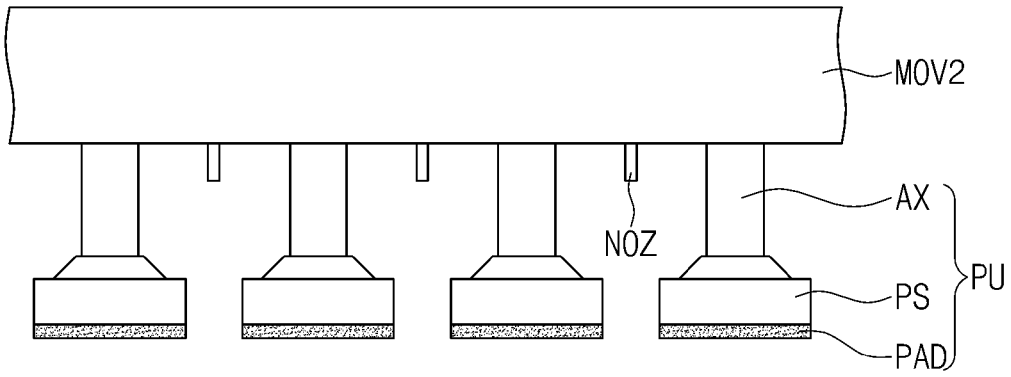
FIG. 2 is an elevation view illustrating a side surface of a portion of polishing units illustrated in FIG. 1.

FIG. 1 is a perspective view illustrating a substrate polishing apparatus according to an exemplary embodiment of the invention. FIG. 2 is an elevation view illustrating a side surface of a portion of polishing units illustrated in FIG. 1.

Referring to FIGS. 1 and 2, a substrate polishing apparatus 100 according to an exemplary embodiment of the invention includes support parts 110 and 120, first moving parts MOV1, second moving parts MOV2, a plurality of polishing units PU, a plurality of nozzles NOZ (refer to FIG. 3), and a stage 130.

The support parts 110 and 120 include long sides in a first direction DR1, and short sides in a second direction DR2 crossing the first direction DR1. The support parts 110 and 120 include a first support part 110 and a second support part 120 disposed on the first support part 110. Substrates SUB1 and SUB2 are disposed on the second support part 120.

The lengths of the first and second support parts 110 and 120 may be the same in the first direction DR1. The length of the first support part 110 is longer than that of the second support part 120 in the second direction DR2. In the second direction DR2, a region of the first support part 110 except for predetermined regions at both opposite sides of the first support part 110 is disposed to overlap the second support part 120.

The first support part 110 includes moving grooves MG defined in predetermined regions at both opposite sides of the first support part 110 in the second direction DR2. The moving grooves MG are defined in the first support part 110 which does not overlap the second support part 120 in the second direction DR2.

Since the moving grooves MG are respectively defined in predetermined regions at both opposite sides of the first support part 110, two moving grooves MG may be defined in the first support part 110. The moving grooves MG are downwardly recessed from an upper surface of the first support part 110. The moving grooves MG extend in the first direction DR1.

The second support part 120 includes a grove G downwardly recessed from an upper surface thereof. The groove G includes a long side in the first direction DR1, and a short side in the second direction DR2.

The first moving parts MOV1 may be disposed at predetermined regions at both opposite sides of the support parts 110 and 120 in the second direction, and upwardly extends. Specifically, the first moving parts MOV1 are disposed on the first support part 110 of predetermined regions at both opposite sides of the first support part 110 in the second direction DR2.

The first moving parts MOV1 are disposed respectively (i.e., in a one to one relation) corresponding to the moving grooves MG. The first moving parts MOV1 may reciprocate in the first direction DR1 along the moving grooves MG. Although not shown, rollers moving along the moving grooves MG may be defined under the first moving parts MOV1.

Each of the first moving parts MOV1 includes a first extension part EX1 disposed at predetermined regions at both opposite sides of the first support part 110 in the second direction DR2 and extending in an upward direction, and two second extension parts EX2 connected to an upper side of the first extension part EX1 and extending in the second direction DR2. The first and second extension parts EX1 and EX2 may have a shape of a curved surface.

The first extension parts EX1 may be disposed respectively corresponding to the moving grooves, and reciprocate in the first direction along the moving groves MG. The second extension parts EX2 of the first moving parts MOV1 extends in a direction toward an inner side of the support part in the second direction DR2. Each of the second extension parts EX2 of the first moving parts MOV1 is spaced apart from each other in the first direction DR1, and extending in the second direction DR2.

The stage 130 is disposed on the support parts 110 and 120. The stage 130 is disposed in the groove G. In a plane defined by the first and second directions DR1 and DR2, the planar size of the stage 130 is smaller than the planar size of the groove G. The stage 130 includes a long side in the first direction DR1, and a short side in the second direction DR2.

In a third direction crossing the first and second directions DR1 and DR2, the thickness of the stage 130 may have a value greater than or equal to the depth of the groove G. That is, the height of an upper surface of the stage 130 may be higher than or equal to the height of an upper surface of the second support part 120.

At least one substrate may be disposed on the stage 130. In an exemplary embodiment, the first and second substrates SUB1 and SUB2 may be arranged and disposed in the first direction DR1 on the stage 130, for example. In FIG. 1, although the first and second substrates SUB1 and SUB2 are exemplarily disposed on the stage 130, the exemplary embodiment of the invention is not limited thereto. Thus, one substrate or two or more substrates may be disposed on the stage 130.

In FIG. 1, although the first and second substrates SUB1 and SUB2 are illustrated as being the same size, exemplary embodiments of the invention are not limited thereto. Thus, substrates with various sizes may be disposed on the stage 130.

Since the height of the upper surface of the stage 130 is higher than or equal to the height of the second support part 120, upper surfaces of the first and second substrates SUB1 and SUB2 may be disposed higher than the height of the second support part 120.

When the height of the upper surface of the stage 130 is lower than the height of the second support part 120, the upper surfaces of the first and second substrates SUB1 and SUB2 may be disposed lower than the height of the second support part 120. In this case, the polishing units PU polishing the upper surfaces of the first and second substrates SUB1 and SUB2 may be interfered by the groove when revolving with a predetermined trajectory. Accordingly, the height of the upper surface of the stage 130 may be set higher than or equal to the height of the upper surface of the second support part 120.

The stage 130 functions to fix the first and second substrates SUB1 and SUB2. In an exemplary embodiment, the stage 130 may fix the first and second substrates SUB1 and SUB2 by using vacuum adsorption, for example.

The second moving part MOV2 is disposed on the first and second substrates SUB1 and SUB2. The second moving part MOV2 is disposed between the first moving parts MOV1 in the second direction DR2, and connected to an upper side of the first moving parts MOV1.

Specifically, predetermined regions at both opposite sides of the second moving part MOV2 are respectively disposed between the second extension parts EX2, and connected to the second extension parts EX2. In an exemplary embodiment, predetermined regions at one side of the second moving part MOV2 in the second direction are disposed between the second extension parts EX2 of the first moving part MOV1 which is disposed at a predetermined region at one side of the first support part 110, and connected to the second extension parts EX2, for example.

Predetermined regions at the other side of the second moving part MOV2 in the second direction are disposed between the second extension parts EX2 of the first moving part MOV1 which is disposed at predetermined region at the other side of the first support part 110, and connected to the second extension parts EX2.

The polishing units PU and the nozzles NOZ (refer to FIG. 3) are disposed under the second moving part MOV2. The polishing units PU and the nozzles NOZ may be disposed to face the first and second substrates SUB1 and SUB2.

Each of the polishing units PU includes a rotation axis AX connected to a lower portion of the second moving part MOV2, a pad support part PS disposed under the rotation axis AX, and a polishing pad PAD disposed under the pad support part PS.

In an exemplary embodiment, the length of the nozzles NOZ is shorter than the length of the polishing units PU in the third direction DR3. The polishing pads PAD are pads for polishing upper surfaces of the first and second substrates SUB1 and SUB2.

The nozzles NOZ are fixed, and the polishing units PU may revolve along a predetermined trajectory while rotating. The nozzles NOZ are disposed not to overlap the rotation axes AX of the polishing units PU. Such a configuration will be described below in detail with reference to FIG. 3.

In an exemplary embodiment, the nozzles NOZ downwardly spray slurry which is a chemical polishing agent. The slurry is supplied on the first and second substrates SUB1 and SUB2, for example. The polishing pads PAD may be disposed to contact the upper surfaces of the first and second substrates SUB1 and SUB2. Accordingly, the slurry may be supplied between the polishing pads PAD and the first and second substrates SUB1 and SUB2.

Figure 3:
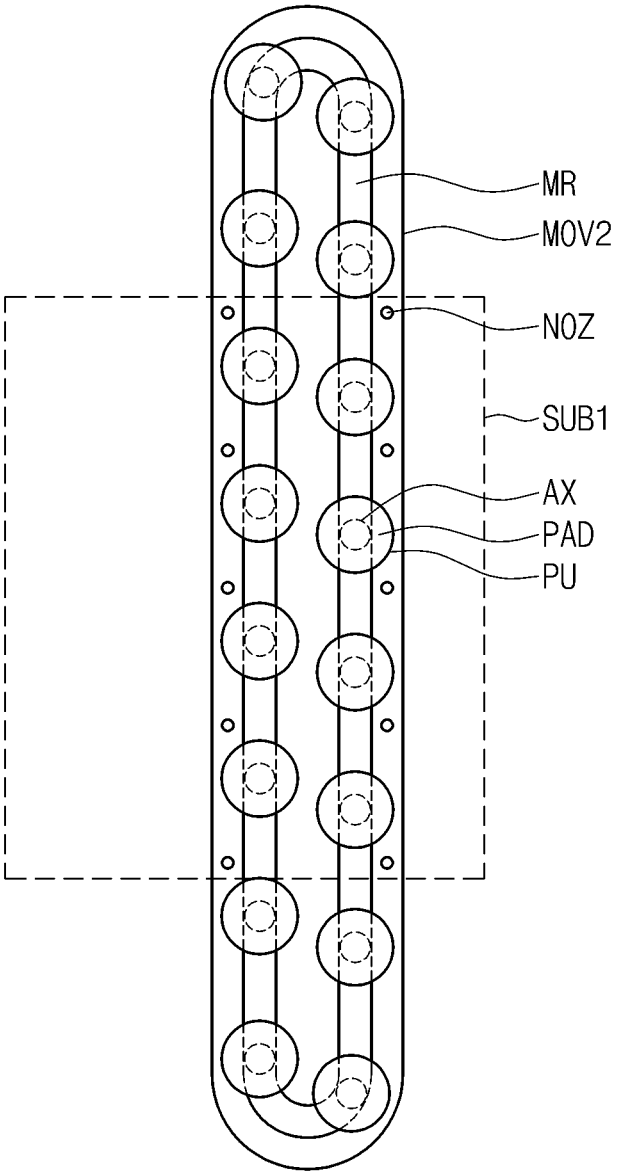
FIG. 3 is a bottom plan view illustrating a bottom surface of the second moving part illustrated in FIG. 1.

FIG. 3 is a bottom plan view illustrating a bottom surface of the second moving part illustrated in FIG. 1.

In FIG. 3, for convenience of description, the first substrate SUB1 disposed under the second moving part MOV2 is illustrated with dotted lines. Also, for convenience of description, the rotation axes of the polishing units PU and a portion of a moving rail part MR overlapping the polishing pads are illustrated with dotted lines in FIG. 3.

Referring to FIG. 3, the second moving part MOV2 has a bar shape extending in the second direction, and both ends of the second moving part MOV2 may have a semi-circular shape. However, the invention is not limited thereto, and second moving part MOV2 may include various other shapes.

The second moving part MOV2 includes the moving rail part MR disposed under the second moving part MOV2 and having a predetermined track. The track of the moving rail part MR extends in the second direction, and the tracks at both side of the moving rail part MR may have a semi-circular shape. However, the invention is not limited thereto, and the track of the moving rail part MR may include various other shapes.

The length of the track of the moving rail part MR is longer than the length of the first substrate SUB1. The track of the moving rail part MR extending in the second direction DR2 is disposed to overlap the first substrate SUB1. The track of the moving rail part MR having a semi-circular shape, for example, is disposed not to overlap the first substrate SUB1.

The rotation axes AX of the polishing units PU are inserted into the moving rail part MR. The polishing units PU may rotate clockwise or counter-clockwise with reference to the rotation axes AX to revolve.

The rotation axes AX move along the moving rail part MR. Accordingly, the polishing units PU may move along a predetermined track to revolve. The polishing units PU may revolve clockwise or counter-clockwise along a predetermined track.

The nozzles NOZ are disposed, in the first direction DR1, to be spaced a predetermined distance toward an inner side of the second moving part MOV2 from both opposite sides of the second moving part MOV2. Also, the nozzles NOZ are arranged in the second direction DR2.

The nozzles NOZ may be disposed to overlap and face the first substrate SUB1. The nozzles NOZ is disposed not to overlap the moving rail part MR. That is, the nozzles NOZ are disposed not to overlap the rotation axes AX of the polishing units PU.

In this case, the slurry downwardly sprayed through the nozzles NOZ downwardly flows along the polishing pads to be supplied to the first substrate SUB1.

Figure 4:
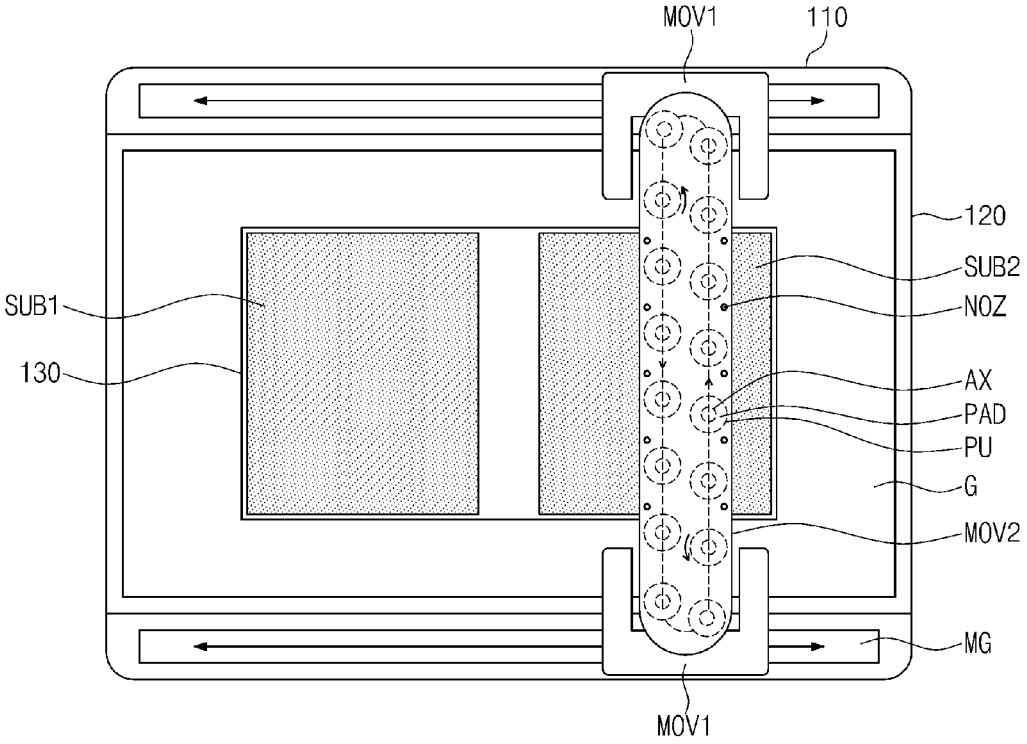
FIG. 4 is a top plan view of the substrate polishing apparatus illustrated in FIG. 1.

FIG. 4 is a top plan view of the substrate polishing apparatus illustrated in FIG. 1.

Hereinafter, the operation of the substrate polishing apparatus will be described with reference to FIG. 4. In FIG. 4, for convenience of description, the polishing units OU and the nozzles NOZ disposed at the second moving part MOV2 are illustrated with dotted lines.

Also, the rotations of the polishing units PU are illustrated with solid arrows, and revolving directions of the polishing units PU are illustrated with dotted lines. Since the revolving orbits of the polishing units PU are illustrated by depicting a revolving direction, the moving rail part MR is not illustrated and omitted.

Referring to FIG. 4, the moving part MOV1 reciprocates in the first direction DR1. The slurry is downwardly sprayed from the nozzles NOZ and is supplied to the first and second substrates SUB1 and SUB2.

The polishing pads PAD of the polishing units PU are disposed to contact the upper surface of the first and second substrates SUB1 and SUB2. The slurry sprayed from the nozzles NOZ may be supplied between the polishing pads PAD and the first and second substrates SUB1 and SUB2.

Since the polishing units PU reciprocates in the first direction DR1 by the first moving part MOV1, the polishing pads PAD may contact the first and second substrates SUB1 and SUB2.

The polishing units PU may rotate clockwise or counter-clockwise about the rotation axes AS. Also, the polishing units PU may revolve counter-clockwise along the moving rail part MR. However, the exemplary embodiment of the invention is not limited thereto, and the polishing units PU may rotate and revolve clockwise. Also, the directions of revolution and rotation of the polishing units PU may be set opposite to each other.

Through these operations, the polishing pads PAD of the polishing units PU may uniformly contact the upper surface of the first and second substrates SUB1 and SUB2.

The slurry is supplied between the polishing pads PAD and the first and second substrates SUB1 and SUB2, and the polishing pads PAD move on the upper surface of the first and second substrates SUB1 and SUB2 while rotating and revolving, so that the upper surface of the first and second substrates SUB1 and SUB2 may be polished. As a result, protrusions disposed on the first and second substrates SUB1 and SUB2 are removed, and the first and second substrates SUB1 and SUB2 may be smoothed.

When the upper plate is used, although the size of the upper plate becomes larger as the size of the substrate becomes larger, it may be difficult to support the upper plate as the size of the upper plate disposed at an upper portion becomes larger than the lower plate.

However, in an exemplary embodiment of the invention, the upper plate is not used, and the first and second substrates SUB1 and SUB2 are disposed on the stage 130 disposed at a lower portion than the polishing pads PAD. Accordingly, unlike the upper plate, substrates with various sizes may be disposed on the stage 130. As a result, by polishing the first and second substrates SUB1 and SUB2 disposed on the stage 130 while reciprocating the polishing units PU rotating and revolving along a predetermined orbit reciprocates in a predetermined direction, substrates with various sizes may be polished.

Consequently, the substrate polishing apparatus 100 according to an exemplary embodiment of the invention may easily polish substrates with various sizes.

The substrate polishing apparatus according to embodiments of the invention polishes the first and second substrates SUB1 and SUB2 disposed on the stage 130 while reciprocating the polishing units PU rotating and revolving along a predetermined orbit reciprocates in a predetermined direction. Thus, substrates with various sizes may be polished.

While exemplary embodiments are described above, a person skilled in the art may understand that many modifications and variations may be made without departing from the spirit and scope of the invention defined in the following claims. Also, embodiments disclosed in the disclosure are not intended to limit the technical spirit of the invention and the following claims and all technical spirits falling within equivalent scope are construed as being included in the scope of rights of the invention.

What is claimed is:

1. A substrate polishing apparatus comprising:

a support part on which at least one substrate is disposed;

a plurality of first moving parts disposed at both opposite sides of the support part in a second direction crossing a first direction, and configured to upwardly extend and reciprocate in the first direction;

a second moving part disposed between the plurality of first moving parts in the second direction and connected to an upper side of the first moving parts;

a plurality of polishing units disposed at a lower portion of the second moving part and configured to contact an upper surface of the substrate; and a plurality of nozzles disposed at the lower portion of the second moving part and configured to spray slurry to the substrate, wherein the plurality of polishing units rotates and revolves along a predetermined trajectory.

2. The substrate polishing apparatus of claim 1, wherein the support part comprises:

a first support part on which the first moving parts are disposed; and a second support part disposed on the first support part, wherein the first moving parts are disposed on predetermined regions at both opposite sides of the first support part in the second direction, and the substrate is disposed on the second support part.

3. The substrate polishing apparatus of claim 2, wherein a length of the first support part and a length of the second support part are the same in the first direction, the length of the first support part is longer than the length of the second support part in the second direction, and a region of the first support part except for the predetermined regions at both opposite sides of the first support part are disposed to overlap the second support part.

4. The substrate polishing apparatus of claim 3, wherein a moving grooves downwardly recessed from an upper surface of the first support part in the predetermined regions of both opposite sides of the first support part, and configured to extend in the first direction is defined in the first support part, and the first moving parts are disposed respectively corresponding to the moving grooves and reciprocates in the first direction along the moving grooves.

5. The substrate polishing apparatus of claim 2, wherein a groove downwardly recessed from an upper surface of the second support part is defined in the second support part.

6. The substrate polishing apparatus of claim 5, further comprising a stage disposed at the groove, wherein the substrate is disposed on the stage and fixed.

7. The substrate polishing apparatus of claim 6, wherein in a third direction crossing the first and second directions, a thickness of the stage is greater than or equal to a depth of the groove.

8. The substrate polishing apparatus of claim 1, wherein each of the first moving parts comprises:

a first extension part disposed on predetermined regions at both opposite sides of the first support part in the second direction and configured to upwardly extend and configured to reciprocate in the first direction; and two second extension parts connected to an upper side of the first extension part and configured to extend in a direction toward an inner side of the support part in the second direction, wherein predetermined regions at both opposite sides of the second moving part in the second direction are disposed between the second extension parts and connected to the second extension parts.

9. The substrate polishing apparatus of claim 8, wherein a portion to which the first and second extension parts are connected has a shape of a curved surface.

10. The substrate polishing apparatus of claim 1, wherein each of the plurality of polishing units comprises:

a rotation axis connected to a lower portion of the second moving part;

a pad support part disposed under the rotation axis; and a polishing pad disposed under the pad support part, wherein each polishing unit rotates clockwise or counter-clockwise about the rotation axis.

11. The substrate polishing apparatus of claim 10, wherein lengths of the plurality of nozzles in a third direction crossing the first and second directions are smaller than lengths of the rotation axes.

12. The substrate polishing apparatus of claim 10, wherein the second moving part comprises a moving rail part disposed on the lower portion of the second moving part and configured to have a predetermined track, wherein the rotation axes are inserted into the moving rail part and move along the predetermined track in a clockwise or counter-clockwise direction along the moving rail part.

13. The substrate polishing apparatus of claim 12, wherein the track of the moving rail part extends in the second direction, and the tracks at both opposite sides of the moving rail part in the second direction has a semi-circular shape.

14. The substrate polishing apparatus of claim 13, wherein a length of the track of the moving rail part in the second direction is greater than a length of the substrate, and the track of the moving rail part, which has the semi-circular shape is disposed not to overlap the substrate.

15. The substrate polishing apparatus of claim 12, wherein the plurality of nozzles is spaced apart by a predetermined distance from both opposite sides of the second moving part toward an inner side of the second moving part in the first direction, and arranged in the second direction.

16. The substrate polishing apparatus of claim 15, wherein the plurality of nozzles overlaps the first substrate, and is separated from the moving rail part in a plan view.

17. The substrate polishing apparatus of claim 1, wherein the plurality of nozzles is fixed and sprays the slurry.

* * * * *